US010836166B2

(12) United States Patent
Sameshima et al.

(10) Patent No.: US 10,836,166 B2
(45) Date of Patent: Nov. 17, 2020

(54) INKJET HEAD

(71) Applicant: Konica Minolta, Inc., Tokyo (JP)

(72) Inventors: Kouichi Sameshima, Tokyo (JP); Hideyuki Eguchi, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/320,756

(22) PCT Filed: Jun. 20, 2017

(86) PCT No.: PCT/JP2017/022682
§ 371 (c)(1),
(2) Date: Jan. 25, 2019

(87) PCT Pub. No.: WO2018/020910
PCT Pub. Date: Feb. 1, 2018

(65) Prior Publication Data

US 2019/0160817 A1 May 30, 2019

(30) Foreign Application Priority Data

Jul. 27, 2016 (JP) ..... 2016-147578

(51) Int. Cl.
*B41J 2/14* (2006.01)
*B41J 2/18* (2006.01)

(52) U.S. Cl.
CPC ..... *B41J 2/14233* (2013.01); *B41J 2/18* (2013.01); *B41J 2002/14241* (2013.01);
(Continued)

(58) Field of Classification Search
CPC ..... B41J 2/18; B41J 2/14274; B41J 2/14233; B41J 2002/14419; B41J 2002/14491;
(Continued)

(56) References Cited

U.S. PATENT DOCUMENTS

2012/0176450 A1 7/2012 Akahane et al.
2013/0076836 A1 3/2013 Yokota
(Continued)

FOREIGN PATENT DOCUMENTS

JP 2008200902 A 9/2008
JP 2008-290292 * 12/2008
(Continued)

OTHER PUBLICATIONS

Extended European Search Report corresponding to Application No. 17833920.6-1019/3492263 PCT/JP2017022682; dated Jun. 11, 2019.
(Continued)

*Primary Examiner* — Juanita D Jackson
(74) *Attorney, Agent, or Firm* — Cantor Colburn LLP

(57) ABSTRACT

This inkjet head comprises: a nozzle plate including a plurality of nozzles; a vibration plate including a pressure chamber to store ink to be ejected from the nozzle; a spacer plate containing a piezoelectric layer to apply pressure to the pressure chamber; a vibration board provided between the pressure chamber and the piezoelectric layer to transmit deformation of the piezoelectric layer to the pressure chamber; and an intermediate substrate between the pressure chamber plate and the nozzle plate, the intermediate substrate including a communication flow path that communicates with the nozzle and the pressure chamber. The nozzle plate includes: an individual circulation flow path provided for each of the plurality of nozzles to discharge ink; and a common circulation flow path into which a plurality of individual circulation flow paths merge.

11 Claims, 10 Drawing Sheets

(52) U.S. Cl.
CPC ..... *B41J 2002/14419* (2013.01); *B41J 2002/14491* (2013.01); *B41J 2202/12* (2013.01)

(58) Field of Classification Search
CPC ..... B41J 2002/14241; B41J 2002/1853; B41J 2002/14217; B41J 2002/14306; B41J 2002/14225; B41J 2202/12; B41J 2202/21
See application file for complete search history.

(56) References Cited

U.S. PATENT DOCUMENTS

| | | | | |
|---|---|---|---|---|
| 2013/0194353 | A1* | 8/2013 | Hirai et al. ..... | B41J 2/14274 |
| 2014/0160200 | A1 | 6/2014 | Kim et al. | |
| 2015/0165767 | A1 | 6/2015 | Owaki et al. | |

FOREIGN PATENT DOCUMENTS

| | | | |
|---|---|---|---|
| JP | 2008290292 | A | 12/2008 |
| JP | 2015036202 | A | 2/2015 |
| JP | 2015134507 | A | 7/2015 |

OTHER PUBLICATIONS

International Search Report corresponding to Application No. PCT/JP2017/022682; dated Jul. 25, 2017.
Written Opinion of the International Searching Authority corresponding to Application No. PCT/JP2017/022682; dated Jul. 25, 2017.
CNIPA 1st Chinese Office Action for corresponding Application No. 20178004558.4, dated Jan. 22, 2020.

* cited by examiner

FIG.8

| COMMUNICATION FLOW PATH LENGTH μm | NEGATIVE PRESSURE kPa | DRIVING VOLTAGE V |
|---|---|---|
| TARGET VALUE | -360 OR MORE | 25 OR LESS |
| 450 | -407 | 27.8 |
| 350 | -368 | 26.2 |
| 300 | -356 | 25.1 |
| 250 | -339 | 24.2 |
| 150 | -312 | 22.8 |

INKJET HEAD

CROSS REFERENCE TO PRIOR APPLICATIONS

This is the U.S. national stage of application No. PCT/JP2017/022682, filed on Jun. 20, 2017. Priority under 35 U.S.C. § 119(a) and 35 U.S.C. § 365(b) is claimed from Japanese Application No. 2016-147578, filed Jul. 27, 2016, the disclosure of which is also incorporated herein by reference.

TECHNOLOGICAL FIELD

The present invention relates to the structure of an inkjet head.

BACKGROUND

In recent years, in order to prevent poor ejection due to, for example, thickening of ink and generation of air bubbles near nozzles in an inkjet head, there is a known technique to collect thickened ink and air bubbles via a circulation flow path provided near nozzles. For example, Japanese Laid-Open Patent Publication No. 2008-290292 (PTL 1) discloses a mechanism having a circulation flow path in a plate (discharge-hole plate) superposed on a nozzle plate so as to circulate ink.

CITATION LIST

Patent Literature

PTL 1: Japanese Laid-Open Patent Publication No. 2008-290292

SUMMARY

Technical Problem

In the configuration described in the above PTL 1, however, an additional discharge-hole plate is required to form a circulation flow path, which increases the distance from the pressure chambers to the nozzles by the thickness of the discharge-hole plate. The increased distance from the pressure chambers to the nozzles causes deterioration in ink ejection properties.

An object of the present invention, which has been made in view of the above problem, is to provide an inkjet head with a configuration that can prevent deterioration in ink ejection properties.

Solution to Problem

This inkjet head comprises: a nozzle plate including a plurality of nozzles; a vibration plate including a pressure chamber to store ink to be ejected from the nozzle; a spacer plate containing a piezoelectric layer to apply pressure to the pressure chamber; and a flow path formation substrate between the vibration plate and the nozzle plate, the flow path formation substrate including a communication flow path that communicates with the nozzle and the pressure chamber.

The vibration plate includes a vibration board provided between the pressure chamber and the piezoelectric layer to transmit deformation of the piezoelectric layer to the pressure chamber. The nozzle plate includes an individual circulation flow path provided for each of the plurality of nozzles to discharge ink, and a common circulation flow path into which a plurality of the individual circulation flow paths merge.

In another mode, the nozzle plate includes a nozzle support layer located adjacent to the flow path formation substrate, and a nozzle layer located opposite to the flow path formation substrate across the nozzle support layer. The individual circulation flow path and the common circulation flow path are provided in the nozzle support layer.

In another mode, the nozzle plate is an SOI substrate.

In another mode, the common circulation flow path is provided also in the flow path formation substrate.

In another mode, a columnar member is disposed in the common circulation flow path.

In another mode, a recess is provided at a part of an outer surface of the nozzle plate over which the common circulation flow path is provided, the recess being recessed toward the common circulation flow path.

In another mode, in plan view, the common circulation flow path includes a curved portion.

Advantageous Effects of Invention

The present invention provides an inkjet head with a configuration that can prevent deterioration in ink ejection properties.

BRIEF DESCRIPTION OF THE DRAWINGS

FIG. 8 shows parameters in an example.

DETAILED DESCRIPTION OF EMBODIMENTS

Inkjet heads in embodiments based on the present invention are described hereinafter with reference to the drawings. In the embodiments described hereinafter, when reference is made to the number, quantity and the like, the scope of the present invention is not necessarily limited to the number, quantity and the like, unless otherwise noted. Identical or corresponding parts are identically denoted, and the redundant description is not repeated in some cases. It is assumed from the start that the features in the embodiments may be combined as appropriate. Some parts of the drawings are shown not in accordance with the ratio of the actual dimensions but with the ratio being changed to clarify the structure for easier understanding of the structure.

Embodiment 1: Configuration of Inkjet Head 1

Figure 1:
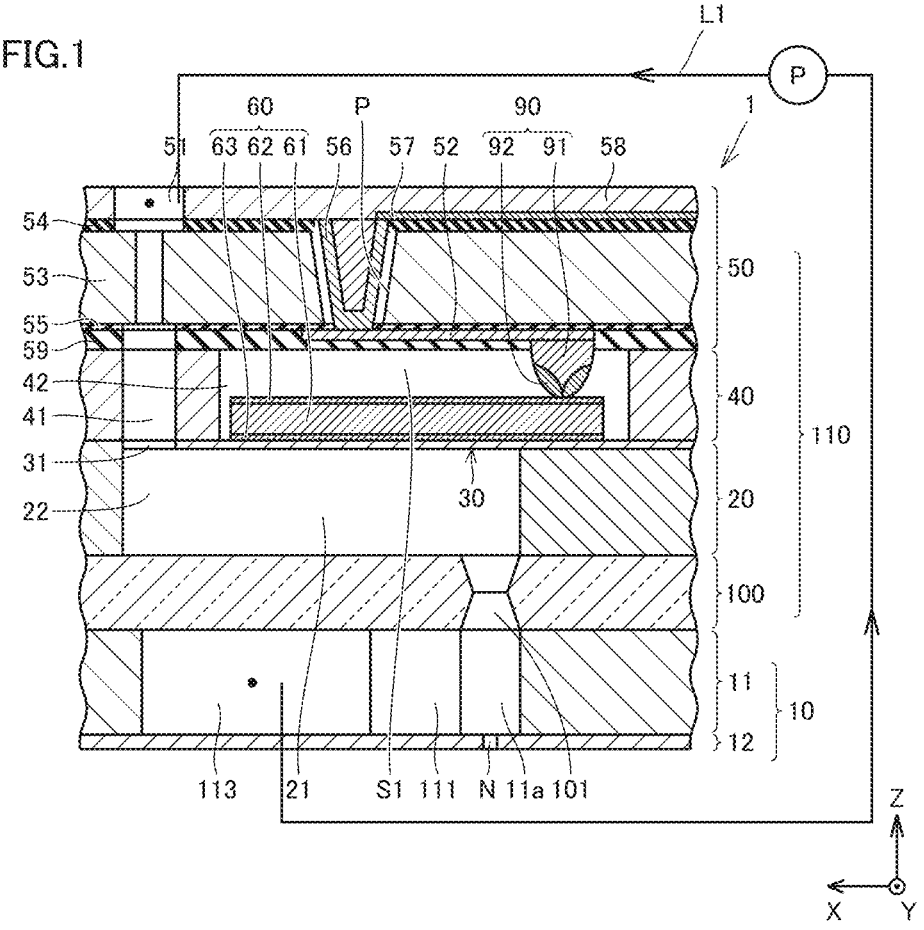
FIG. 1 is a cross-sectional view showing the structure of an inkjet head in embodiment 1.
Figure 2:
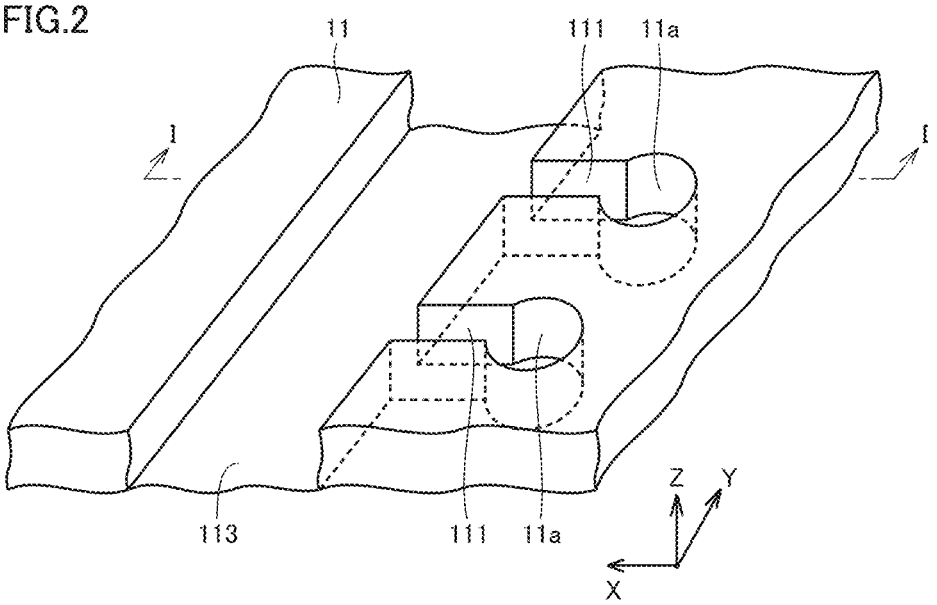
FIG. 2 is a perspective view showing the configuration of a nozzle plate in embodiment 1.

With reference to FIG. 1 and FIG. 2, the configuration of an inkjet head 1 according to the present embodiment is described. FIG. 1 is a cross-sectional view showing the structure of inkjet head 1. FIG. 2 is a perspective view showing the configuration of a nozzle plate 10. The cross section taken along line I-I in FIG. 2 corresponds to the cross-sectional view of FIG. 1.

In FIG. 1, the plane on which a nozzle N is provided is defined as an X-Y plane. The directions along the plane and orthogonal to each other are defined as an X direction and a Y direction. The direction orthogonal to the X-Y plane is defined as a Z direction. The Z-axis direction corresponds to the vertical direction.

With reference to FIG. 1, inkjet head 1 includes nozzle plate 10 and a head chip 110. Nozzle plate 10 has nozzle N to eject ink. Nozzle N extends through nozzle plate 10. Nozzle plate 10 includes a nozzle support layer 11 and a nozzle layer 12. Nozzle support layer 11 has a passage 11*a*, and nozzle layer 12 has nozzle N which communicates with passage 11*a*.

A plurality of nozzles N and passages 11*a* are provided in line along the Y-axis direction, for example. Usually, nozzles N are arranged in a matrix. The number of nozzles (channels) is, for example, 1024 (16×64).

As nozzle plate 10, a silicon on insulator (SOI) substrate may be used, for example. Nozzle plate 10 is not limited to an SOI substrate but may be made of, for example, SUS, 42Alloy, or polyimide. A water-repellent film may be formed on the lower face of nozzle plate 10.

Head chip 110 is formed by stacking a plurality of substrates and the like along the Z direction on the upper face of nozzle plate 10. Specifically, head chip 110 is formed by stacking an intermediate substrate 100, a vibration plate 20 including a pressure chamber 21, a spacer substrate 40, and a wiring substrate 50, on nozzle plate 10.

Vibration plate 20 includes a vibration board 30 provided between pressure chamber 21 and a piezoelectric layer 60 (described later) to transmit deformation of piezoelectric layer 60 to pressure chamber 21.

Thus, in nozzle plate 10, nozzle support layer 11 is located adjacent to intermediate substrate 100, and nozzle layer 12 is located opposite to intermediate substrate 100 across nozzle support layer 11.

Intermediate substrate 100 has a connection passage 101 which connects nozzle N and pressure chamber 21. Intermediate substrate 100, vibration plate 20, vibration board 30, spacer substrate 40, and wiring substrate 50 have ink supply flow paths 22, 31, 41, 51 which communicate with pressure chamber 21. The flow path of ink formed by the ink supply flow paths connects pressure chamber 21 and an external ink supply flow path provided above wiring substrate 50.

Intermediate substrate 100 is provided for the purpose of providing connection passage 101 between nozzle plate 10 and vibration plate 20, for example. Connection passage 101 communicates with pressure chamber 21 and nozzle N and adjusts kinetic energy to be applied to ink when the ink is ejected.

Providing connection passage 101 makes it possible for the flow path of ink that leads to nozzle N to have any desired shape.

Intermediate substrate 100 may be made of any material, such as glass, stainless steel, resin, silicon, or the like.

Vibration plate 20 is provided on intermediate substrate 100. Vibration plate 20 includes pressure chamber 21 to store ink. Pressure chamber 21 communicates with nozzle N via connection passage 101 of intermediate substrate 100. A plurality of pressure chambers 21 are provided along the Y-axis direction for a plurality of nozzles N arranged along the Y-axis direction, on a one-to-one basis, so that each pressure chamber 21 communicates with corresponding nozzle N. Pressure chamber 21 is provided independently of ink supply flow path 22.

Vibration board 30 provided in vibration plate 20 covers an opening 42 in spacer substrate 40 in which piezoelectric layer 60 is contained. Vibration board 30 forms one face (upper face) of pressure chamber 21. Vibration board 30 can be vibrated by piezoelectric layer 60 provided on vibration board 30. Vibration of vibration board 30 increases or decreases the pressure in pressure chamber 21.

Spacer substrate 40 allows for a space corresponding to the heights of piezoelectric layer 60 and a connection portion 90 (described later) along the Z direction between vibration board 30 and wiring substrate 50. Spacer substrate 40 has opening 42 at a location corresponding to the location of piezoelectric layer 60.

Opening 42 extends through spacer substrate 40 in the Z direction. Opening 42 is provided independently of ink supply flow path 41. In opening 42, piezoelectric layer 60 is disposed. Opening 42 is covered with wiring substrate 50. Thus, a closed space 51 is defined around piezoelectric layer 60. Spacer substrate 40 and wiring substrate 50 correspond to a sealing portion to seal piezoelectric layer 60.

Spacer substrate 40 may be made of any material that allows for the above-described space, such as resin member, iron, glass, nickel, stainless steel, silicon, or an alloy, for example.

Wiring substrate 50 includes, for example, an interposer 53, insulating layers 54, 55, a through-substrate via 56, an interconnection 57, an insulating layer 58, an interconnection 52, an insulating layer 59, and ink supply flow path 51.

Interposer 53 is in the shape of a plate. Interposer 53 is the base of wiring substrate 50. Insulating layer 54 covers the upper face of interposer 53. Insulating layer 55 covers the lower face of interposer 53.

Through-substrate via 56 is provided in a through-hole P extending through insulating layer 54, interposer 53, and insulating layer 55. Interconnection 57 is provided on the upper face of insulating layer 54 and electrically connected to the upper end of through-substrate via 56.

Insulating layer 58 covers the upper face of interconnection 57 and the upper face of the part of insulating layer 54 where interconnection 57 is not provided.

Interconnection 52 is provided on the lower face of insulating layer 55 and electrically connected to the lower end of through-substrate via 56. Interconnection 52 is connected to a controller (not shown) to control the voltage to be applied to piezoelectric layer 60 via through-substrate via 56 and interconnection 57.

Interconnections 52, 57 may be formed by, for example, patterning conductive metal (e.g. Cr, Ti, and Au) by photolithography. For example, interconnections 52, 57 may be formed by forming films of Cr and Au on the substrate in this order, then patterning Au, and then patterning Cr. Cr or Ti is used as an adhesion layer for Au.

Insulating layer 59 covers the lower face of the part of interconnection 52 where a bump 91 is not formed, and covers the lower face of the part of insulating layer 55 where interconnection 52 is not provided. Ink supply flow path 51 extends through insulating layer 58, insulating layer 54, interposer 53, insulating layer 55, and insulating layer 59.

Piezoelectric layer 60 is electrically connected to interconnection 52 provided in wiring substrate 50 via connection portion 90 (described later). Each piezoelectric layer 60 is provided for a corresponding one of a plurality of nozzles N arranged along the Y-axis direction. Piezoelectric layer 60 is provided on vibration board 30.

Piezoelectric layer 60 includes a piezoelectric portion 61 formed by a piezoelectric layer, a first electrode 62 covering one surface of piezoelectric portion 61, and a second electrode 63 covering the other surface of piezoelectric portion 61.

First electrode 62 is electrically connected to interconnection 52 via connection portion 90. Connection portion 90 connects first electrode 62 and interconnection 52 along the Z direction. Connection portion 90 includes bump 91 formed on wiring substrate 50.

Bump 91 is formed by, for example, wire bonding using gold as the material. Bump 91 is formed, for example, on the lower face of interconnection 52. A conductive material 92 is applied to the lower end of bump 91. Specifically, conductive material 92 is, for example, a conductive adhesive. The conductive adhesive is an adhesive that contains conductive powdered metal (e.g. powdered silver).

Thus, connection portion 90 electrically connects wiring substrate 50 and piezoelectric layer 60 via bump 91 formed on wiring substrate 50 and via conductive material 92 applied to bump 91.

Second electrode 63 is in contact with an electrode layer (not shown) formed on vibration board 30. The electrode layer formed on vibration board 30 functions as an electrode that electrically connects second electrode 63 and the above-described controller. Second electrode 63 is connected to the controller via, for example, an interconnection (not shown) connected to the electrode layer formed on vibration board 30.

The electrode layer may be formed by, for example, patterning conductive metal (e.g. Cr, Ti, and Au) by photolithography on vibration board 30. For example, the electrode layer may be formed by forming films of Cr and Au on the substrate in this order, then patterning Au, and then patterning Cr. Cr or Ti is used as an adhesion layer for Au.

First electrode 62 is connected to the controller via connection portion 90, interconnection 52, through-substrate via 56, and interconnection 57. Second electrode 63 is connected to the controller via the electrode layer formed on vibration board 30. Thus, piezoelectric layer 60 can operate under the control of the controller.

Operation of piezoelectric layer 60 causes vibration board 30 to vibrate. This causes a change in internal pressure in pressure chamber 21, thereby allowing the ink that has been supplied to pressure chamber 21 to eject from nozzle N.

An epoxy adhesive is preferably used to bond the above-described intermediate substrate 100 and nozzle plate 10. If glass is used as the material of intermediate substrate 100 and silicon is used as the material of nozzle plate 10, then anodic bonding may be used to bond the glass and the silicon.

It is preferable that the differences in coefficient of thermal expansion between the substrates be sufficiently small. This can prevent the substrates from warping and coming off from one another due to temperature changes during bonding of the substrates and due to heat generated during operation of inkjet head 1.

For example, silicon is used as the material of the above-described vibration plate 20, vibration board 30, and wiring substrate 50; and 42Alloy (alloy containing 42% by weight of nickel, 57% by weight of iron, the balance including a very small amount of additive [e.g. copper, manganese, or the like]) is used as the material of spacer substrate 40. This achieves small differences in coefficient of thermal expansion between the substrates.

In inkjet head 1 in the above-described embodiment, vibration board 30 is integrated with vibration plate 20. However, inkjet head 1 is not limited to such a configuration. Vibration board 30 and vibration plate 20 may be separately provided.

(Nozzle Plate 10)

With reference to FIG. 2, the configuration of nozzle support layer 11 which constitutes nozzle plate 10 is described. Nozzle support layer 11 includes individual circulation flow paths 111 each provided for a corresponding one of a plurality of nozzles N and each communicating with a corresponding passage 11*a* to discharge ink. Further, nozzle support layer 11 has a common circulation flow path 113 into which a plurality of individual circulation flow paths 111 merge. In FIG. 2, individual circulation flow paths 111 extend in the X direction, and common circulation flow path 113 linearly extends in the Y direction.

As described above, 1024 (16×64) nozzles N (channels) are provided, for example. Individual circulation flow path 111 is provided for each nozzle N, whereas a single common circulation flow path 113 is provided for all the nozzles N. Alternatively, nozzles N may be divided into some groups, and a plurality of common circulation flow paths 113 may be provided for the respective groups.

Thus, inkjet head 1 in the present embodiment includes individual circulation flow path 111 provided for each of a plurality of nozzles N to discharge ink, and common circulation flow path 113 into which a plurality of individual circulation flow paths 111 merge. Thus, as shown in FIG. 1, the ink supplied to nozzle N but not ejected to the outside is discharged through individual circulation flow path 111 to common circulation flow path 113 and is then supplied again, through a circulation line L1, to ink supply flow paths 22, 31, 41, 51 which communicate with pressure chamber 21. In this way, deterioration in ink ejection properties can be prevented.

Since individual circulation flow path 111 and common circulation flow path 113 are provided in the same nozzle support layer 11, an additional substrate is not required to manufacture inkjet head 1 in the present embodiment. Therefore, increase in cost can be prevented.

The length of individual circulation flow path 111, from pressure chamber 21 to nozzle plate 10, can be shortened compared with the configuration having an additional substrate for individual circulation flow path 111. This achieves low-voltage driving. Further, a shortened path from pressure chamber 21 to nozzle plate 10 reduces the negative pressure, thus preventing increase in negative pressure at pressure chamber 21.

Further, since there is no need to make nozzle support layer 11 thinner to provide individual circulation flow path 111 and common circulation flow path 113, it is possible to avoid generation of cracks during bonding of nozzle support layer 11 and the substrates in head chip 110 in the manufacturing process and also avoid their warps due to heat. Thus, the productivity of inkjet head 1 can be improved.

Although the present embodiment discloses a configuration in which the ink discharged from the common circulation flow path circulates through circulation line L1, it is needless to say that a configuration without circulation is also possible. For example, ink may be discharged from common circulation flow path 113 without passing through circulation line L1.

Embodiment 2: Configuration of Inkjet Head 1A

Figure 3:
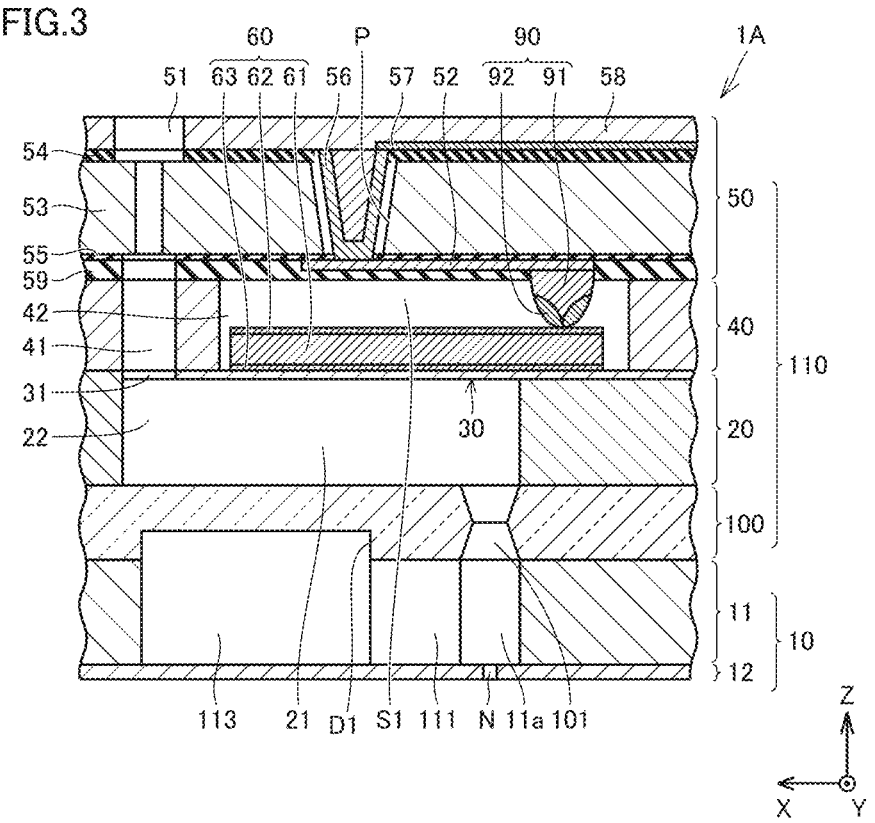
FIG. 3 is a cross-sectional view showing the structure of an inkjet head in embodiment 2.

With reference to FIG. 3, the configuration of an inkjet head 1A according to the present embodiment is described.

FIG. 3 is a cross-sectional view showing the structure of inkjet head 1A. The cross section taken along line I-I in FIG. 2 corresponds to the cross-sectional view of FIG. 1.

The basic configuration is the same as the configuration of inkjet head 1 in the above-described embodiment 1. The difference is that common circulation flow path 113 is provided not only in nozzle support layer 11 but also in intermediate substrate 100.

Inkjet head 1A having this configuration can bring about the same advantageous effects as those of inkjet head 1 in the above-described embodiment 1. Further, common circulation flow path 113 extended into intermediate substrate 100 allows for an enlarged cross section of common circulation flow path 113 and thus an increased quantity of flow of circulating ink, without increasing the size of inkjet head 1A in the Z direction.

Further, a step portion D1, which is formed at the connecting portion between individual circulation flow path 111 and common circulation flow path 113, causes a flow from individual circulation flow path 111 drawn into common circulation flow path 113. Thus, air bubbles in individual circulation flow path 111 can be easily drawn into the flow in common circulation flow path 113. This can reduce air bubbles staying in passage 11*a* and more effectively prevent deterioration in ink ejection properties.

Embodiment 3: Configuration of Inkjet Head 1B

Figure 4:
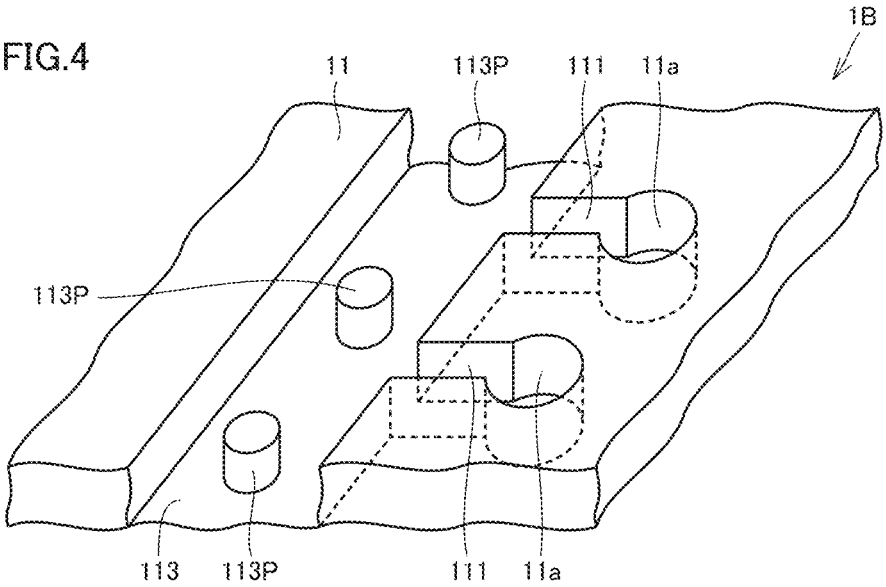
FIG. 4 is a perspective view showing the configuration of a nozzle plate in embodiment 3.

With reference to FIG. 4, the configuration of an inkjet head 1B according to the present embodiment is described. FIG. 4 is a perspective view showing the configuration of nozzle plate 10.

The basic configuration is the same as the configuration of inkjet head 1 in the above-described embodiment 1. The difference is that a plurality of columnar members 113P are arranged in common circulation flow path 113 provided in nozzle plate 10. Columnar members 113P may be disposed at any positions. In order not to affect the flow of ink from individual circulation flow path 111 to common circulation flow path 113, each columnar member 113P is provided preferably at a position that does not face individual circulation flow path 111. For example, each columnar member 113P may be provided between adjacent individual circulation flow paths 111.

Inkjet head 1B having this configuration can bring about the same advantageous effects as those of inkjet head 1 in the above-described embodiment 1. Further, nozzle layer 12 in nozzle plate 10 serves as a damper (shock absorber) by deforming. Columnar members 113P provided in common circulation flow path 113 reinforce nozzle layer 12. Also, columnar members 113P reduce deformation of nozzle layer 12 if more deformation than is expected occurs in nozzle layer 12. This can avoid damage to nozzle layer 12.

Further, the damper, which needs to bend toward intermediate substrate 100, requires a gap between columnar members 113P and intermediate substrate 100. A possible method includes the following (i) to (iii):

(i) removing a film (e.g. an oxide film) that covers the surface of nozzle support layer 11, only from the parts of columnar members 113P;

(ii) applying an adhesive to the surface of nozzle support layer 11, other than columnar members 113P, to bond it to intermediate substrate 100; and (iii) the adhesive containing beads for controlling the thickness.

Embodiment 4: Configuration of Inkjet Head 1C

Figure 5:
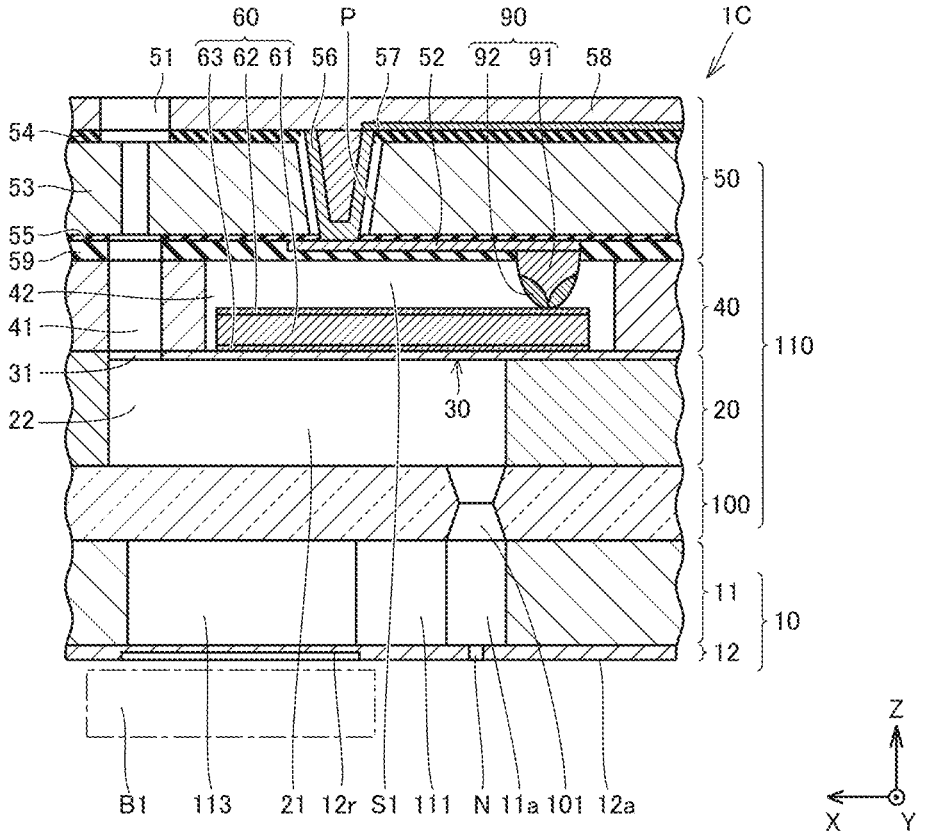
FIG. 5 is a cross-sectional view showing the configuration of a nozzle plate in embodiment 4.

With reference to FIG. 5, the configuration of an inkjet head 1C according to the present embodiment is described. FIG. 5 is a cross-sectional view showing the configuration of nozzle plate 10.

The basic configuration is the same as the configuration of inkjet head 1 in the above-described embodiment 1. The difference is that a recess 12*r* is provided at a part of the outer surface (nozzle surface) 12*a* of nozzle plate 10 over which common circulation flow path 113 is provided, the recess 12*r* being recessed toward common circulation flow path 113. The area where recess 12*r* is provided preferably includes the area where common circulation flow path 113 is provided.

Inkjet head 1C having this configuration can bring about the same advantageous effects as those of inkjet head 1 in the above-described embodiment 1. Further, during cleaning of outer surface (nozzle surface) 12*a* of nozzle plate 10, a blade, made of an elastic body, is made to slide on outer surface (nozzle surface) 12*a* while being in contact with the surface 12*a*. At this time, the moving direction of blade B1 is the Y direction in the drawing, and the width of the blade in the X direction is broader than the width of recess 12*r*. Thus, the bottom face of recess 12*r* is prevented from being touched by blade B1.

This prevents deformation of nozzle layer 12 during cleaning of outer surface (nozzle surface) 12*a* with blade B1, thus avoiding damage to nozzle layer 12.

Embodiment 5: Configuration of Inkjet Head 1D

Figure 6:
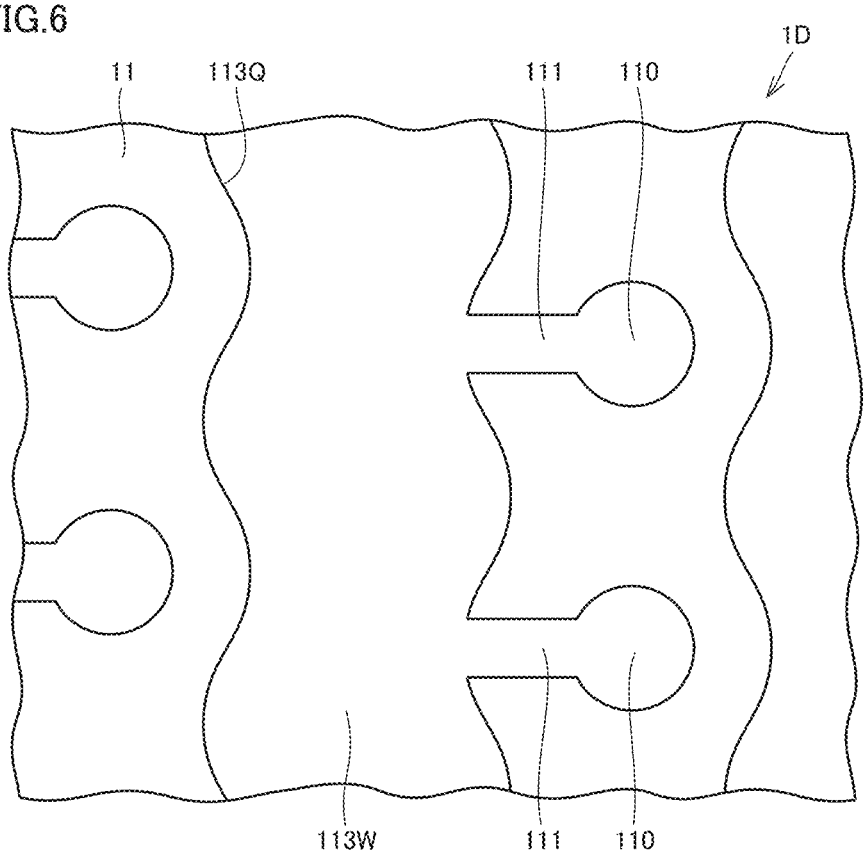
FIG. 6 is a plan view showing the configuration of a nozzle plate in embodiment 5.

With reference to FIG. 6, the configuration of an inkjet head 1D according to the present embodiment is described. FIG. 6 is a plan view showing the configuration of nozzle plate 10.

The basic configuration is the same as the configuration of inkjet head 1 in the above-described embodiment 1. The difference is that a common circulation flow path 113W provided in nozzle plate 10 includes a curved portion. Common circulation flow path 113 of inkjet head 1 in embodiment 1 shown in FIG. 2 has a linear shape along the Y direction. On the other hand, common circulation flow path 113W of inkjet head 1C in the present embodiment has a gentle S-curve in plan view. Specifically, a side wall 113Q which constitutes common circulation flow path 113W of nozzle plate 10 has a wavy shape toward circulation flow paths.

Inkjet head 1D having this configuration can bring about the same advantageous effects as those of inkjet head 1 in the above-described embodiment 1. Further, since side wall 113Q which constitutes common circulation flow path 113W of nozzle plate 10 has a wavy shape toward circulation flow paths, side wall 113Q serves as a member to reinforce nozzle layer 12. Also, if more deformation (stress) than is expected occurs in nozzle layer 12, cracks in a plane of cleavage of silicon in nozzle support layer 11 is prevented under stress. Therefore, cracks can be prevented during assembly and driving of the head.

The wavy shape of common circulation flow path 113W is preferably a pattern such that individual circulation flow paths 111 are the longest. This allows thickened fluid and air bubbles to be easily discharged.

EXAMPLE

Figure 7:
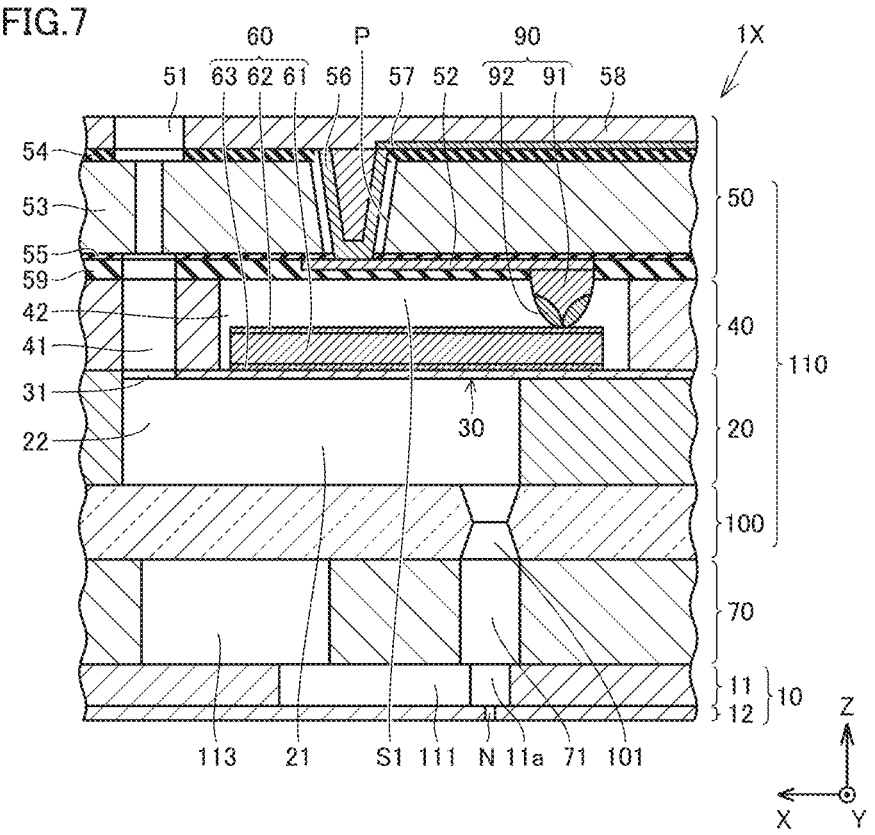
FIG. 7 is a cross-sectional view showing the structure of an inkjet head in related art.

An example is described hereinafter. Inkjet head 1 having the configuration shown in FIG. 1 and an inkjet head 1X having the configuration shown in FIG. 7 were compared with each other in performance. Inkjet head 1X shown in FIG. 7 includes a circulation plate 70 having common circulation flow path 113 and an ink supply flow path 71, and nozzle support layer 11 has individual circulation flow path 111. Accordingly, the entire thickness of inkjet head 1X in the Z direction is larger than that of inkjet head 1.

Here, the length of the ink flow path from pressure chamber 21 to nozzle layer 12, formed by connection passage 101, passage 11*a*, and ink supply flow path 71, is defined as a "communication flow path length". The "communication flow path length" of inkjet head 1 shown in FIG. 1 is 270 μm. On the other hand, the "communication flow path length" of inkjet head 1X shown in FIG. 6 is 420 μm.

FIG. 8 shows the relation between the negative pressure (kPa) of pressure chamber 21 and the driving voltage (V) for driving piezoelectric layer 60 for each communication flow path length. A preferable target value of the negative pressure (kPa) is −360 (kPa) or more, and a preferable target value of the driving voltage is 25 V or less.

Figure 9:
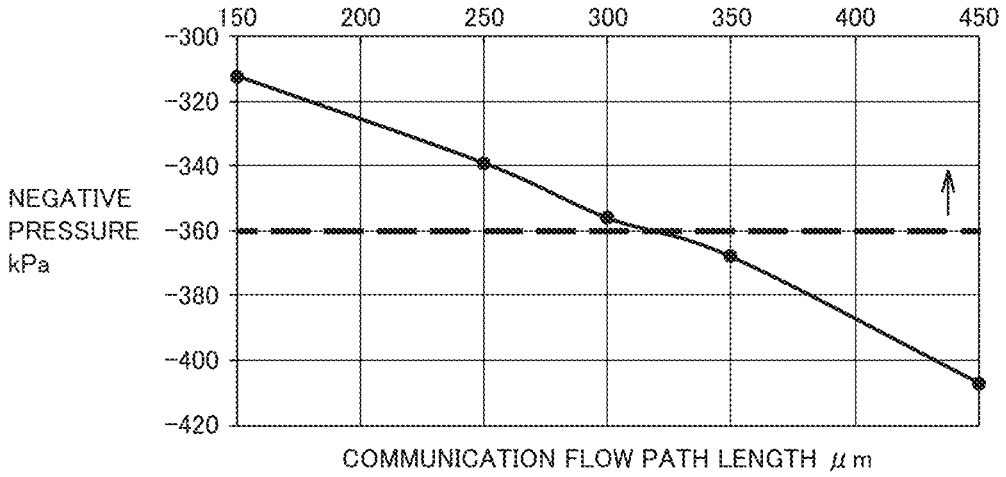
FIG. 9 shows the relation between the communication flow path length and the negative pressure in an example.
Figure 10:
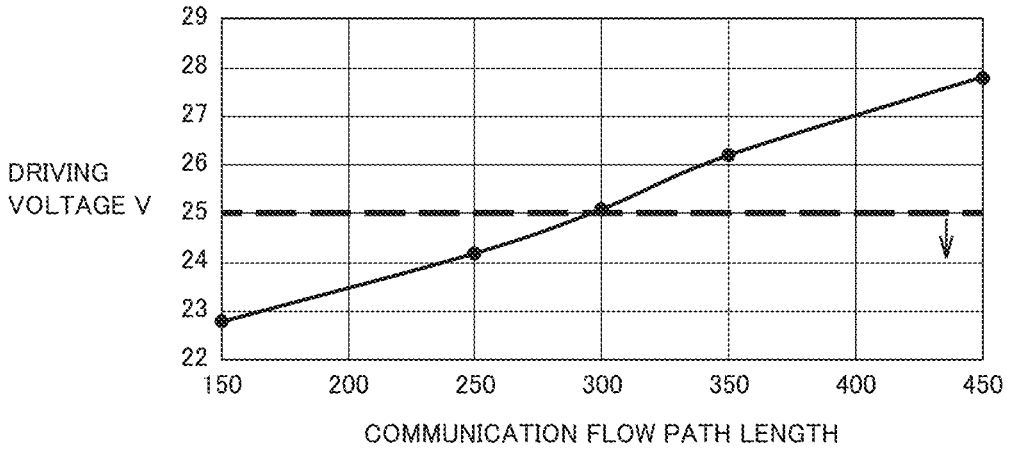
FIG. 10 shows the relation between the communication flow path length and the driving voltage in an example.

When the "communication flow path length" is 450 μm, the negative pressure is −407 (kPa) and the driving voltage is 27.8 (V). When the "communication flow path length" is 350 μm, the negative pressure is −368 (kPa) and the driving voltage is 26.2 (V). When the "communication flow path length" is 300 μm, the negative pressure is −356 (kPa) and the driving voltage is 25.1 (V). When the "communication flow path length" is 250 μm, the negative pressure is −339 (kPa) and the driving voltage is 24.2 (V). When the "communication flow path length" is 150 μm, the negative pressure is −312 (kPa) and the driving voltage is 22.8 (V). FIG. 9 shows the relation between the "communication flow path length" and the negative pressure. FIG. 10 shows the relation between the "communication flow path length" and the driving voltage.

It is shown that a "communication flow path length" of about 300 μm or less can achieve a negative pressure (kPa) of −360 (kPa) or more. It is shown that a "communication flow path length" of about 300 μm or less can also achieve a driving voltage of 25 V or less. Inkjet head 1 shown in FIG. 1, whose "communication flow path length" is 270 μm, can satisfy the target values of the negative pressure and the driving voltage. On the other hand, inkjet head 1X shown in FIG. 7, whose "communication flow path length" is 420 μm, cannot satisfy the target values of the negative pressure and the driving voltage.

It should be understood that the embodiments and the example disclosed herein are by way of example in every respect, not by way of limitation. The scope of the present invention is defined not by the above description but by the terms of the claims. It is intended that the scope of the present invention includes any modification within the meaning and the scope equivalent to the terms of the claims.

REFERENCE SIGNS LIST

1, 1A, 1B, 1C, 1D: inkjet head; 10: nozzle plate; 11: nozzle support layer; 11*a*: passage; 12: nozzle layer; 12*r*: recess; 20: vibration plate; 21: pressure chamber; 22, 41, 51, 71, 102: ink supply flow path; 30: vibration board; 40: spacer substrate; 42: opening; 50: wiring substrate; 52, 57: interconnection; 53: interposer; 54, 55, 58, 59: insulating layer; 56: through-substrate via; 60: piezoelectric layer; 61: piezoelectric portion; 62: first electrode; 63: second electrode; 90: connection portion; 91: bump; 92: conductive material; 100: intermediate substrate; 101: connection passage; 110: head chip; 111: individual circulation flow path; 113, 113W: common circulation flow path; 113P: columnar member; 113Q: side wall; B1: blade; D1: step portion; N: nozzle

The invention claimed is:

1. An inkjet head comprising:

a nozzle plate including a plurality of nozzles;

a vibration plate including a pressure chamber to store ink to be ejected from the nozzle;

a spacer plate containing a piezoelectric layer to apply pressure to the pressure chamber; and a flow path formation substrate between the vibration plate and the nozzle plate, the flow path formation substrate including a communication flow path that communicates with the nozzle and the pressure chamber, the vibration plate including a vibration board provided between the pressure chamber and the piezoelectric layer to transmit deformation of the piezoelectric layer to the pressure chamber, the nozzle plate including an individual circulation flow path provided for each of the plurality of nozzles to discharge ink, and a common circulation flow path into which a plurality of the individual circulation flow paths merge;

wherein the individual circulation flowpath and the common circulation flowpath are formed in a same nozzle support layer.

2. The inkjet head according to claim 1, wherein the nozzle plate includes a nozzle support layer located adjacent to the flow path formation substrate, and a nozzle layer located opposite to the flow path formation substrate across the nozzle support layer, and the individual circulation flow path and the common circulation flow path are provided in the nozzle support layer.

3. The inkjet head according to claim 2, wherein the common circulation flow path is provided also in the flow path formation substrate.

4. The inkjet head according to claim 3, wherein a columnar member is disposed in the common circulation flow path.

5. The inkjet head according to claim 2, wherein a columnar member is disposed in the common circulation flow path.

6. The inkjet head according to claim 1, wherein the nozzle plate is a silicon on insulator substrate.

7. The inkjet head according to claim 1, wherein the common circulation flow path is provided also in the flow path formation substrate.

8. The inkjet head according to claim 7, wherein a columnar member is disposed in the common circulation flow path.

9. The inkjet head according to claim 1, wherein a columnar member is disposed in the common circulation flow path.

10. The inkjet head according to claim 1, wherein a recess is provided at a part of an outer surface of the nozzle plate over which the common circulation flow path is provided, the recess being recessed toward the common circulation flow path.

11. The inkjet head according to claim wherein, in plan view, the common circulation flow path includes a curved portion.

* * * * *